US008896192B2

(12) United States Patent
Kato

(10) Patent No.: US 8,896,192 B2
(45) Date of Patent: Nov. 25, 2014

(54) SPARK PLUG AND METHOD OF MANUFACTURING THE SAME

(75) Inventor: Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 1075 days.

(21) Appl. No.: 12/819,547

(22) Filed: Jun. 21, 2010

(65) Prior Publication Data

US 2010/0320893 A1 Dec. 23, 2010

(30) Foreign Application Priority Data

Jun. 22, 2009 (JP) ..... 2009-147150

(51) Int. Cl.

| | |
|---|---|
| ***H01T 13/20*** | (2006.01) |
| ***H01T 21/02*** | (2006.01) |
| ***H01T 21/06*** | (2006.01) |
| ***H01T 13/32*** | (2006.01) |

(52) U.S. Cl.

CPC ..... *H01T 21/06* (2013.01); *H01T 21/02* (2013.01); *H01T 13/32* (2013.01)

USPC ..... 313/141; 445/7

(58) Field of Classification Search

USPC ..... 313/118–145; 445/7

See application file for complete search history.

(56) References Cited

U.S. PATENT DOCUMENTS

| | | | | |
|---|---|---|---|---|
| 3,958,144 | A * | 5/1976 | Franks | 313/138 |
| 4,540,912 | A * | 9/1985 | Matesco | 313/142 |
| 2005/0174025 | A1 * | 8/2005 | Okamoto | 313/143 |
| 2008/0042541 | A1 * | 2/2008 | Mayor | 313/141 |

FOREIGN PATENT DOCUMENTS

JP 2003-229231 A 8/2003

* cited by examiner

*Primary Examiner* — Andrew Coughlin
(74) *Attorney, Agent, or Firm* — Sughrue Mion, PLLC

(57) ABSTRACT

A spark plug and manufacturing method. The spark plug (1) includes a metallic shell (3) extending along an axis CL1, a ceramic insulator (2), a center electrode (5), and a ground electrode (27) having a base end portion joined to a front end face (26) of the metallic shell (3). The method includes assembling the metallic shell (3) and a center electrode assembly (41); and joining the ground electrode (27) to the front end face (26). The distance between a reference plane SP perpendicular to the axis CL1 and the front end face (26) as measured along the axis CL1 varies in the circumferential direction. In the joining step, the position of the distal end portion of the ground electrode (27) relative to the front end portion of the center electrode assembly (41) along the axis CL1 is adjusted by changing the region of the front end face (26) to which the ground electrode (27) is joined.

11 Claims, 10 Drawing Sheets

SPARK PLUG AND METHOD OF MANUFACTURING THE SAME

BACKGROUND OF THE INVENTION

1. Field of the Invention

The present invention relates to a spark plug for use in an internal combustion engine, etc., and to a method of manufacturing the same.

2. Description of the Related Art

A spark plug used for an internal combustion engine such as an automotive engine includes, for example, a center electrode extending in an axial direction, an insulator which surrounds the center electrode, a cylindrical metallic shell fitted onto the insulator, and a ground electrode having a base end portion joined to a front end portion of the metallic shell. The ground electrode is bent at an intermediate portion thereof such that a distal end portion of the ground electrode faces a front end portion of the center electrode, whereby a spark discharge gap is formed between the front end portion of the center electrode and the distal end portion of the ground electrode.

When the metallic shell and a subassembly composed of the insulator and the center electrode provided therein (hereinafter also referred to as the "center electrode assembly") are assembled, a variation may arise in the position of a front end portion of the center electrode assembly relative to the metallic shell. Therefore, in general, a worker bends the ground electrode, while checking the position of the center electrode assembly, after assembling the center electrode assembly and the metallic shell; i.e., after determining the position of the center electrode assembly relative to the metallic shell. A method of bending the ground electrode will be described in detail. First, the worker cuts a distal end portion of the ground electrode in consideration of the position of the center electrode assembly so that, after the ground electrode is bent, the distal end portion of the ground electrode has a desired positional relation with the front end portion of the center electrode assembly. Subsequently, the worker places a bending jig between the center electrode assembly and the ground electrode, and presses the distal end portion of the ground electrode toward the center electrode, while adjusting the bending amount, etc. Thus, the ground electrode is bent. Through this procedure, the ground electrode can be disposed at a desired position, and a spark discharge gap of a proper size can be formed.

In recent years, for the purpose of increasing the degree of freedom in determining engine layout and other purposes, there has been a demand for downsized spark plugs. In order to meet this demand, decreasing the spark plug diameter has been proposed in order to obtain downsized spark plugs.

Decreasing the diameter of a spark plug requires shortening a length of a portion of the ground electrode extending from the bent portion to the distal end portion, as measured along a direction perpendicular to an axis of the spark plug (that is, bending the ground electrode more tightly). Therefore, a larger force must be applied to the ground electrode to bend the same. However, when a large force is applied to the ground electrode, a portion of the ground electrode other than the portion to be bent may become deformed.

Furthermore, when the diameter of a spark plug is decreased, the center electrode assembly and the ground electrode become closer to each other. Therefore, the bending jig to be inserted between the center electrode assembly and the ground electrode must be relatively thin (slender). Accordingly, although the jig must have a sufficiently large strength so as to resist a large force applied to the ground electrode, the jig may fail to have sufficient strength. That is, when the above-described method is used, in addition to deformation of the ground electrode caused by applying a large force thereto, deformation of the ground electrode attributable to deformation/breakage of the jig may also occur. Therefore, when spark plugs having different diameters are manufactured, a difficulty is encountered in forming the ground electrode into a desired bent shape.

In a technique proposed to avoid such difficulty in bending, a ground electrode is bent in advance, and the bent ground electrode is joined to a metallic shell (see, for example, Patent Document 1, etc.).

[Patent Document 1] Japanese Patent Application Laid-Open (kokai) No. 2003-229231

3. Problems to be Solved by the Invention

As described above, a variation may arise in the position of the center electrode assembly relative to the metallic shell. Therefore, in the case where a previously bent ground electrode is joined to the metallic shell, a difficulty is encountered in disposing the ground electrode in a desired position relative to the center electrode assembly.

Furthermore, in the case of the above-described method in which the ground electrode is bent after assembling the center electrode assembly and the metallic shell, the distal end portion of the ground electrode must be cut in order to cope with variation in the position of the center electrode assembly relative to the metallic shell. Therefore, production cost may increase, and productivity may suffer.

That is, each of the above-noted two methods may encounter difficulty in coping with variation in the position of the center electrode assembly relative to the metallic shell, or may bring about disadvantages, such as a decrease in productivity, even if the method can cope with such a variation.

SUMMARY OF THE INVENTION

The present invention has been accomplished in view of the foregoing, and an object thereof is to provide a spark plug in which a ground electrode can be disposed at a position corresponding to a variation in the position of a center electrode assembly relative to a metallic shell, without causing disadvantages, such as a decrease in productivity, and which can be applied to the production of spark plugs of reduced diameter. Another object of the present invention is to provide a method of manufacturing the spark plug.

Hereinbelow, configurations suitable for achieving the above-described objectives will be described in turn. Notably, as needed, the action and effects specific to each configuration will be described in turn.

Configuration 1:

A method of manufacturing a spark plug comprising a tubular metallic shell extending in a direction of an axis; a tubular insulator provided inside the metallic shell; a rod-like center electrode provided inside the insulator; and a ground electrode whose base end portion is joined to a front end face of the metallic shell and which forms a gap between a distal end portion thereof and the center electrode, the method comprising:

assembling together the metallic shell and a center electrode assembly including the insulator and the center electrode provided therein; and joining the ground electrode to the front end face of the metallic shell after the assembling step, wherein the distance between a plane perpendicular to the axis and the front end face of the metallic shell as measured along the axis varies in a circumferential direction of the metallic shell; and the joining step comprises adjusting the position of a distal end portion of the ground electrode relative to the front end portion of the center electrode assembly along the axis by changing a region of the front end face of the metallic shell to which the ground electrode is joined.

Notably, the distance between a plane (hereinafter also referred to as a "reference plane") perpendicular to the axis and the front end face of the metallic shell can be changed in the circumferential direction, for example, by inclining the front end face of the metallic shell such that the front end face intersects with the axis non-perpendicularly, or by providing steps on the front end face of the metallic shell. Furthermore, a noble metal chip may be provided on at least one of the center electrode and the ground electrode. Notably, in the case where a noble metal chip is provided on one electrode, the gap is formed between the noble metal chip and the other electrode. Meanwhile, in the case where a noble metal chip is provided on each of the two electrodes, a gap is formed between the two noble metal chips.

According to Configuration 1, the front end face of the metallic shell is configured such that the distance from the reference plane varies along the circumferential direction. Therefore, the position of the ground electrode relative to the center electrode assembly along the axis can be adjusted by changing the region of the front end face of the metallic shell to which the ground electrode is joined. Accordingly, in the case where a method of joining a previously bent ground electrode to the metallic shell is employed, the following advantageous effects are attained for respective types of spark plugs.

That is, in the case of a spark plug of a type in which the distal end portion of the ground electrode faces the front end face of the center electrode and spark discharge occurs in a direction approximately parallel to the axis (or in a direction inclined relative to this direction), since the height of the distal end portion of the ground electrode relative to the center electrode is readily adjusted, the size of the spark discharge gap can be readily adjusted as well.

Further, in the case of a spark plug of a type in which the distal end face of the ground electrode faces the side surface of the center electrode and spark discharge occurs in a direction approximately perpendicular to the axis (or in a direction inclined relative to this direction), the distal end portion of the ground electrode can be disposed to face the side surface of the center electrode without deviation along the axial direction. Accordingly, the above Configuration 1 of the invention can reliably prevent the distal end portion of the ground electrode from being disposed to face a front-end edge portion of the center electrode. As a result, local abrasion at the front-end edge portion can be suppressed, whereby abrasion resistance can be increased. Moreover, in the case where a noble metal chip is provided on the center electrode, in general, the center electrode and the noble metal chip are joined together via a fused portion formed by means of laser welding or the like. According to the present Configuration 1, the possibility of the distal end portion of the ground electrode being disposed to face the fused portion, which has poor abrasion resistance, can be avoided more reliably. As a result, local abrasion of the fused portion caused by spark discharge can be suppressed, and thus, occurrence of problems, such as falling off of the noble metal chip, can be prevented more reliably.

Meanwhile, in the case where a method of joining a straight ground electrode to the metallic shell and bending the ground electrode is employed, work of cutting the distal end portion of the ground electrode in consideration of the position of the center electrode assembly becomes unnecessary. Therefore, productivity can be improved.

Configuration 2:

A spark plug manufacturing method according to Configuration 1, which comprises bending the ground electrode to form a bent portion before the joining step.

According to Configuration 2, the action and effects of Configuration 1 for the case where a previously bent ground electrode is joined to the metallic shell can be attained. Furthermore, according to Configuration 2, the ground electrode can be bent into a desired shape relatively easily, even in the case where a spark plug to be manufactured has a reduced diameter and bending of the ground electrode after the joining step is difficult. In other words, the present Configuration 2 is meaningful in particular when spark plugs having a reduced diameter (e.g., where the nominal diameter of the thread portion is M12 or less or M10 or less) are manufactured.

Configuration 3:

A spark plug manufacturing method according to Configuration 2, wherein the joining step comprises adjusting the size of the gap.

According to Configuration 3, the action and effects similar to those of Configuration 1 are attained in the case of manufacturing a spark plug of a type in which the distal end portion of the ground electrode faces the front end face of the center electrode and spark discharge occurs in a direction approximately parallel to the axis (or in a direction inclined relative to this direction).

Configuration 4:

A spark plug manufacturing method according to Configuration 2 or 3, wherein the ground electrode has a length of 4 mm or less as measured from the bent portion to the distal end thereof.

Notably, the "length as measured from the bent portion to the distal end" refers to a length of a distal-end-side portion of the ground electrode, as measured along a center axis thereof, the distal-end-side portion extending from the center of the bent portion to the distal end of the ground electrode. Furthermore, the "center of the bent portion" refers to a point at which the center axis of the distal-end-side portion of the ground electrode and the center axis of a base-end-side portion of the ground electrode intersect each other.

In the case where the ground electrode is bent after being joined to the metallic shell and the distal-end-side portion of the ground electrode is made short, the ground electrode must be pressed with a larger force. However, in such a case, the following problems may occur. Even when a large force is applied to the ground electrode, the ground electrode cannot be bent sufficiently. Further, as described above, as a result of applying a large force to the ground electrode, a large force acts on the base end portion (joined portion) of the ground electrode, whereby deformation such as strain may occur in the ground electrode.

According to Configuration 4, the ground electrode has a length of 4 mm or less as measured from the bent portion to the distal end thereof, and, therefore, bending of the ground electrode after being joined to the metallic shell is very difficult. However, since the ground electrode is bent before being joined to the metallic shell, the ground electrode can be bent into a desired shape without causing deformation such as strain. Meanwhile, since Configuration 1 is employed, it is possible to solve the above-described problems that would otherwise arise in the case where the method of joining a bent ground electrode to the metallic shell is used (difficulty in disposing the ground electrode at a position corresponding to a variation in the position of the center electrode assembly relative to the metallic shell).

Configuration 5:

A spark plug manufacturing method according to any one of Configurations 2 to 4, wherein a length of the ground electrode as measured from the bent portion to the distal end thereof is smaller than a length of the ground electrode as measured from the bent portion to the base end thereof.

Notably, the "length as measured from the bent portion to the base end" refers to a length of a base-end-side portion of the ground electrode, as measured along a center axis thereof, the base-end-side portion extending from the center of the bent portion to the base end of the ground electrode.

In Configuration 5, the ground electrode is formed such that the length from the bent portion to the distal end thereof is smaller than the length from the bent portion to the base end thereof. If an attempt is made to bend such a ground electrode joined to the metallic shell, the base end portion of the ground electrode is likely to deform due to the force applied at the time of bending. In order to solve this problem, according to the present Configuration 5, the ground electrode is bent before being joined to the metallic shell. Therefore, the ground electrode can be bent more reliably without causing deformation in the base end portion of the ground electrode. Furthermore, since Configuration 1 is employed, it is possible to solve the above-described problems that would otherwise arise in the case where a previously bent ground electrode is joined to the metallic shell.

Configuration 6:

A spark plug manufacturing method according to any one of Configurations 1 to 5, which comprises disposing a jig for adjusting the relative position between the center electrode assembly and the ground electrode when the relative position is adjusted in the joining step.

According to Configuration 6, when the relative position of the ground electrode relative to the center electrode assembly is adjusted, a predetermined jig is disposed therebetween. Therefore, the ground electrode can be disposed more easily at a desired position relative to the center electrode assembly.

Configuration 7:

A spark plug manufacturing method according to any one of Configurations 1 to 6, wherein said joining step comprises capturing at least images of a front end portion of the center electrode assembly and a distal end portion of the ground electrode to obtain data regarding the captured images, and adjusting the position of the ground electrode relative to the center electrode assembly on the basis of the data.

According to Configuration 7, since the data regarding the captured images are used, the ground electrode can be disposed accurately such that the ground electrode has a desired positional relationship with the center electrode assembly.

Configuration 8:

A spark plug manufacturing method according to any one of Configurations 1 to 7, wherein the joining step comprises joining the ground electrode to the front end face of the metallic shell by means of resistance welding in a state in which an angle formed between the plane perpendicular to the axis and a portion of the front end face of the metallic shell to which portion the ground electrode is to be joined differs from an angle formed between the plane and a surface of the ground electrode, which surface of the ground electrode is to be joined to the metallic shell.

According to Configuration 8, when the ground electrode is joined to the front end face of the metallic shell by means of resistance welding, the angle formed between the plane and a portion of the front end face of the metallic shell to which portion the ground electrode is to be joined is made different from the angle formed between the plane and a surface of the ground electrode to be joined to the metallic shell. That is, the joint surfaces of the metallic shell and the ground electrode are made so as not to be parallel to each other. Therefore, at the time of starting the resistance welding, the ground electrode is brought into point contact or line contact with the metallic shell. Accordingly, as compared with the case where the ground electrode and the metallic shell are resistance-welded in a state in which they are in surface contact with each other, the contact resistance between the two members can be increased. As a result, the ground electrode can be joined to the metallic shell more easily and more firmly.

Configuration 9:

A spark plug manufacturing method according to any one of Configurations 1 to 8, which comprises joining a noble metal chip to the distal end portion of the ground electrode before the joining step.

According to Configuration 9, a noble metal chip is joined to the ground electrode which has not yet been joined to the metallic shell. Accordingly, as compared with the case where a noble metal chip is joined to the ground electrode which has already been joined to the metallic shell, a larger space can be secured for joining of the noble metal chip, and the noble metal chip can be joined more reliably.

Configuration 10:

A spark plug comprising a tubular metallic shell extending in an axial direction; a tubular insulator provided inside the metallic shell; a rod-like center electrode provided inside the insulator; and a ground electrode whose base end portion is joined to a front end face of the metallic shell and which forms a gap between a distal end portion thereof and the center electrode, wherein the distance between a plane perpendicular to the axis and the front end face of the metallic shell as measured along the axis varies in a circumferential direction of the metallic shell.

According to Configuration 10, basically, the actions and effects similar to those of Configuration 1, etc., are attained.

Configuration 11:

A spark plug according to Configuration 10, wherein an angle between the plane perpendicular to the axis and the front end face of the metallic shell is from 1° to 2° inclusive.

According to Configuration 11, the angle which the front end face of the metallic shell forms relative to the reference plane is set to a relatively small angle of 2° or less. Accordingly, the position of the distal end portion of the ground electrode relative to the center electrode assembly along the axis can be adjusted accurately. Meanwhile, since the angle which the front end face of the metallic shell forms relative to the reference plane is set to be equal to or greater than 1°, the adjustable range of the position of the distal end portion of the ground electrode relative to the center electrode assembly can be prevented from becoming excessively narrow.

In a state in which the spark plug is attached to an internal combustion engine, the insulator is heated by combustion gas and is cooled by a fresh air-fuel mixture introduced in the next combustion cycle. Here, variation in the projection amount of the insulator in the circumferential direction will be considered. In the case where the front end face of the metallic shell is inclined, the insulator has a portion which projects from the front end of the metallic shell over a relatively small distance, and has a portion which projects from the front end of the metallic shell over a relatively large distance. The portion whose projection amount is relatively small is a portion covered by the metallic shell over a relatively large area thereof. Thus, flow of the air-fuel mixture toward that portion is likely to be prevented by the metallic shell. Therefore, the insulator has a portion which is not cooled sufficiently by the air-fuel mixture and which may be excessively heated. As a result, even before reaching a timing of spark discharge, ignition of the air-fuel mixture may occur due to heat from the excessively heated portion (so-called pre-ignition may occur), whereby malfunctions such as engine breakage may occur.

According to Configuration 11, the angle formed by the front end face of the metallic shell is set to 2° or less. Thus, the occurrence of a situation in which the projection amount of the insulator from the metallic shell greatly varies along the circumferential direction can be prevented. Therefore, it is possible to prevent a portion of the insulator from being excessively heated, and, thus possible to suppress the occurrence of engine problems.

DESCRIPTION OF REFERENCE NUMERALS

Figure 1:
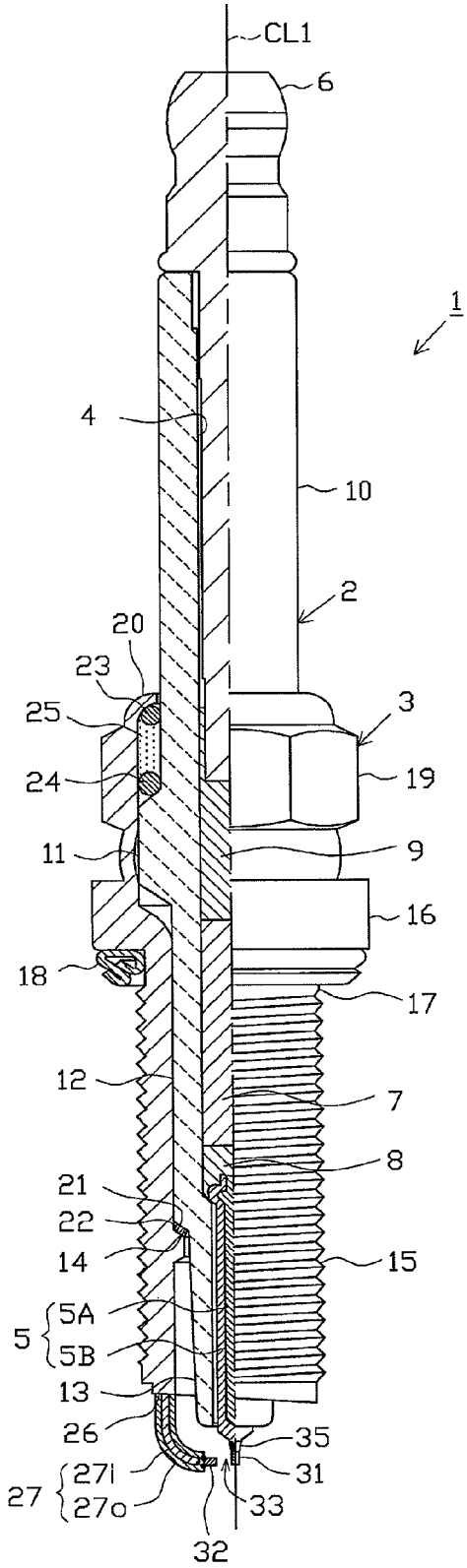
FIG. 1 is a partially sectioned front view showing the structure of a spark plug.

Reference numerals used to identify structural features shown in the drawings include the following.

| | |
|---|---|
| 1, 1A: | spark plug |
| 2: | ceramic insulator |
| 3: | metallic shell |
| 5: | center electrode |
| 26, 26A: | front end face of the metallic shell |
| 27, 27A, 27B: | ground electrode |
| 32: | noble metal chip |
| 33: | gap (spark discharge gap) |
| 41: | center electrode assembly |
| CA1, CA2, CA3: | imaging means |
| CL1: | axis |
| JG1, JG2: | jig |

DETAILED DESCRIPTION OF THE PREFERRED EMBODIMENTS

Certain embodiments will now be described with reference to the drawings. However, the present invention should not be construed as being limited thereto.

First Embodiment

FIG. 1 is a partially sectioned front view showing a spark plug 1. Notably, in FIG. 1, the spark plug 1 is depicted in such a manner that the direction of an axis CL1 of the spark plug 1 coincides with the vertical direction in FIG. 1. Further, in the following description, the lower side of FIG. 1 will be referred to as the front end side of the spark plug 1, and the upper side of FIG. 1 will be referred to as the rear end side of the spark plug 1.

The spark plug 1 is composed of a tubular ceramic insulator 2, a tubular metallic shell 3 which holds the ceramic insulator 2, etc.

As is well known in this field of art, the ceramic insulator 2 is formed from alumina or the like through firing. The ceramic insulator 2 includes a rear-end-side trunk portion 10 formed on the rear end side; a larger diameter portion 11 projecting radially outward on the front end side of the rear-end-side trunk portion 10; an intermediate trunk portion 12 formed on the front end side of the larger diameter portion 11 and having a diameter smaller than that of the larger diameter portion 11; and a leg portion 13 formed on the front end side of the intermediate trunk portion 12 and having a diameter smaller than that of the intermediate trunk portion 12. The larger diameter portion 11, the intermediate trunk portion 12, and the greater part of the leg portion 13 of the ceramic insulator 2 are accommodated within the metallic shell 3. A step portion 14 is formed at a connection portion between the leg portion 13 and the intermediate trunk portion 12. The step portion 14 is tapered such that its diameter decreases toward the front end side. The ceramic insulator 2 engages the metallic shell 3 at the step portion 14.

Furthermore, the ceramic insulator 2 has an axial hole 4 which penetrates the ceramic insulator 2 along the axis CL1. A center electrode 5 is inserted into and fixed to a front end portion of the axial hole 4. The center electrode 5 is composed of an inner layer 5A formed of copper or a copper alloy, and an outer layer 5B formed of a nickel alloy whose predominant component is nickel (Ni). The center electrode 5 assumes a rod-like shape (cylindrical columnar shape) as a whole. A front end portion of the center electrode 5 projects from the front end of the ceramic insulator 2. Furthermore, a cylindrical columnar noble metal chip 31 formed of a noble metal alloy (e.g., an iridium alloy) is joined to the front end portion of the center electrode 5. The noble metal chip 31 is joined to the center electrode 5, by means of laser welding or the like, via a fused portion 35 where a metal which constitutes the center electrode 5 and a noble metal which constitutes the noble metal chip 31 are fused together.

A terminal electrode 6 is fixedly inserted into a rear end portion of the axial hole 4 such that the terminal electrode 6 projects from the rear end of the ceramic insulator 2.

Furthermore, a cylindrical columnar resistor 7 is disposed in the axial hole 4 between the center electrode 5 and the terminal electrode 6. Opposite ends of the resistor 7 are electrically connected to the center electrode 5 and the terminal electrode 6, respectively, via electrically conductive glass seal layers 8 and 9.

In addition, the metallic shell 3 is formed of metal such as low carbon steel and has a tubular shape. A thread portion (external thread portion) 15 for mounting the spark plug 1 onto an engine head is formed on the outer circumferential surface thereof. Further, a seat portion 16 is formed on the outer circumferential surface located on the rear end side of the thread portion 15, and a ring-shaped gasket 18 is fitted into a thread neck potion 17 at the rear end of the thread portion 15. Moreover, a tool engagement portion 19 and a crimped portion 20 are provided at the rear end of the metallic shell 3. The tool engagement portion 19 has a hexagonal cross section, and a tool, such as a wrench, is engaged with the tool engagement portion 19 when the spark plug 1 is mounted to the engine head. The crimped portion 20 holds the ceramic insulator 2 at the rear end portion. Notably, the spark plug 1 of the present embodiment has a reduced size (diameter), and the nominal diameter of the thread portion 15 is M12 or less (e.g., M10 or less).

Furthermore, a step portion 21 with which the ceramic insulator 2 is engaged is provided on the inner circumferential surface of the metallic shell 3. The step portion 21 is tapered such that its diameter decreases toward the front end side with respect to the axis CL1. The ceramic insulator 2 is inserted into the metallic shell 3 from its rear end side toward the front end side. In a state in which the step portion 14 of the ceramic insulator 2 is engaged with the step portion 21 of the metallic shell 3, a rear-end-side opening portion of the metallic shell 3 is crimped radially inward; i.e., the above-mentioned crimped portion 20 is formed, whereby the ceramic insulator 2 is held by the metallic shell 3. Notably, an annular plate packing 22 is interposed between the step portions 14 and 21. Thus, the airtightness of a combustion chamber is secured, to thereby prevent an air-fuel mixture, which enters the clearance between the inner circumferential surface of the metallic shell 3 and the leg portion 13 of the ceramic insulator 2 exposed to the interior of the combustion chamber, from leaking to the outside.

Moreover, in order to further perfect the seal by crimping, annular ring members 23 and 24 are interposed on the rear end side of the metallic shell 3 between the metallic shell 3 and the ceramic insulator 2, and talc powder 25 is charged into the space between the ring members 23 and 24. That is, the metallic shell 3 holds the ceramic insulator 2 via the plate packing 22, the ring members 23 and 24, and the talc 25.

A ground electrode 27 which is bent at an approximate center portion thereof is joined to a front end face 26 of the metallic shell 3. A cylindrical columnar noble metal chip 32 formed of a noble metal alloy (e.g., a platinum alloy) is joined to a distal end portion of the ground electrode 27, and a distal end face of the noble metal chip 32 faces a side surface of the noble metal chip 31. Thus, a spark discharge gap 33 is formed between the noble metal chips 31 and 32, and spark discharge occurs in the spark discharge gap 33 along a direction approximately perpendicular to the axis CL1. Notably, the ground electrode 27 has a double layer structure composed of an outer layer 27*o* and an inner layer 27*i*. The outer layer 27*o* is formed of a nickel alloy (e.g., INCONEL 600 or INCONEL 601, both of which are registered trademarks). The inner layer 27*i* is formed of pure copper or a copper ally, which is a metal having a higher heat conductivity than the above-mentioned nickel alloy.

Figure 2:
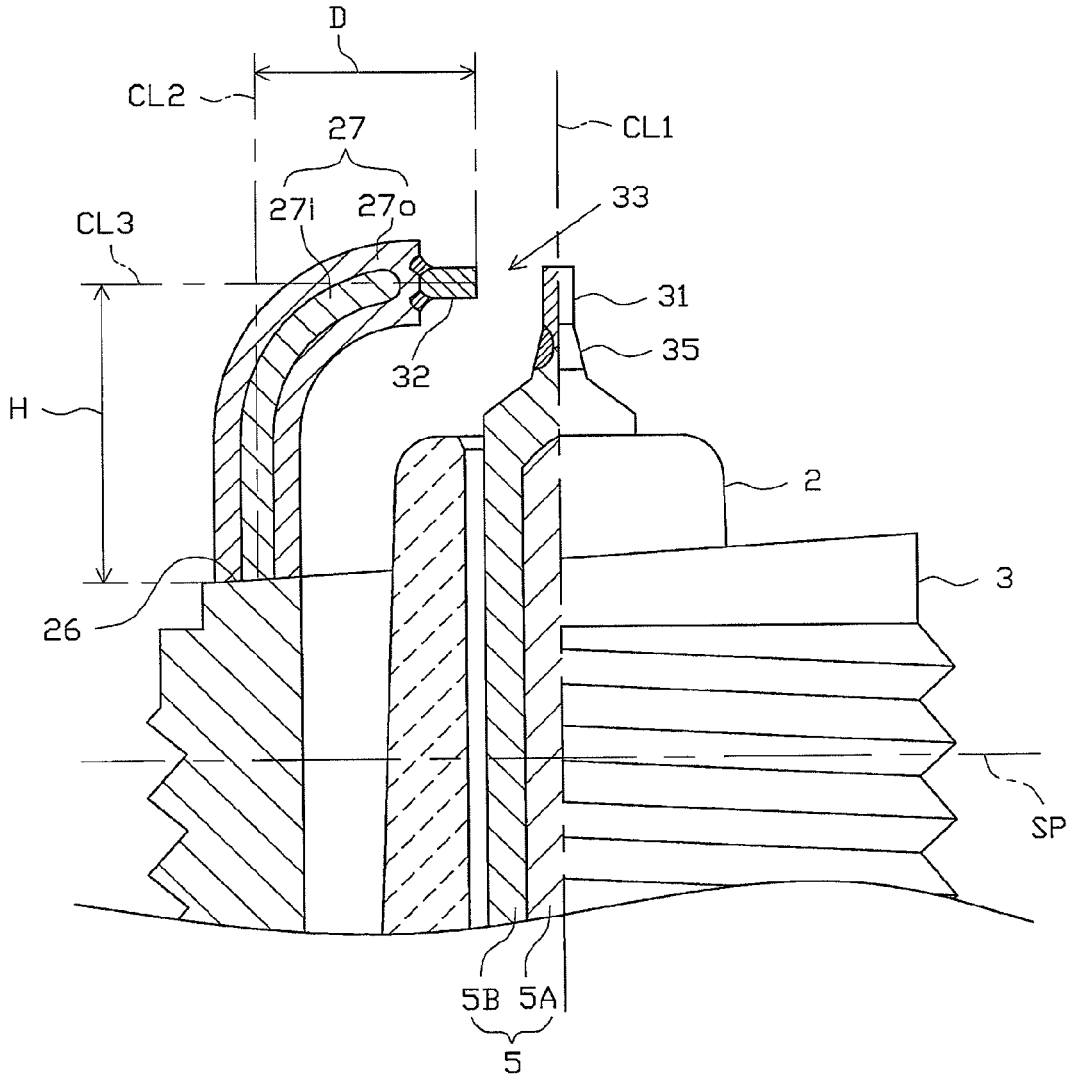
FIG. 2 is a partially sectioned enlarged front view showing the structure of a front end potion of the spark plug.

Moreover, in the present embodiment, as described above, the spark plug 1 has a relatively small diameter. Therefore, as shown in FIG. 2, a length D between a center axis CL2 of a base-end-side portion of the ground electrode 27 and a distal end of the ground electrode 27 (the noble metal chip 32), as measured along a direction perpendicular to the axis CL1, that is, the length of a portion of the ground electrode 27 extending from the bent portion to the distal end thereof is set to 4.0 mm or less. Furthermore, a length H between a center axis CL3 of a distal-end-side portion (the noble metal chip 32) of the ground electrode 27 and the base end of the ground electrode 27, as measured along the axis CL1 (that is, the length of a portion of the ground electrode 27 extending from the bent portion to the base end) is made larger than the length D (e.g., greater than 4.0 mm).

Notably, the "center axis CL2 of the base-end-side portion of the ground electrode 27" means a straight line which extends along the axis CL1 from the center of the base end face of the ground electrode 27. Further, the "center axis CL3 of the distal-end-side portion (the noble metal chip 32) of the ground electrode 27" means a straight line which extends along a direction perpendicular to the axis CL1 from the center of the distal end face of the ground electrode 27 (the noble metal chip 32).

Furthermore, in the present embodiment, the front end face 26 of the metallic shell 3 is inclined to form a predetermined angle (e.g., 1° to 2°) relative to the axis CL1 such that the distance between the front end face 26 and an arbitrary plane (a reference plane) SP perpendicular to the axis CL1, as measured along the axis CL1, varies along the circumferential direction (in order to facilitate understanding, the degree of incline of the front end face 26 is shown in an exaggerated manner in FIG. 2). Notably, the inclination angle of the front end face 26 is set such that the difference between the distance (as measured along the axis CL1) between the reference plane SP and a portion of the front end face 26 closest to the reference plane SP and the distance (as measured along the axis CL1) between the reference plane SP and a portion of the front end face 26 farthest from the reference plane SP becomes 0.2 mm or less.

Next, a method of manufacturing the spark plug 1 configured as described above will be described.

First, the ceramic insulator 2 is formed. For example, material granules for molding are prepared from a material powder containing alumina (predominant component), binder, etc. A cylindrical compact is obtained by performing rubber press molding while using the material granules. Grinding is performed on the thus obtained compact for trimming. The trimmed compact is fired, whereby the ceramic insulator 2 is obtained.

Further, separately from the ceramic insulator 2, the center electrode 5 is manufactured. That is, a nickel alloy, in which a copper alloy is placed at a center portion thereof in order to improve heat radiation performance, is forged so as to fabricate the center electrode 5. Then, the above-mentioned noble metal chip 31 is joined to the front end face of the center electrode 5 through the fused portion 35, which fused portion is formed by means of laser welding or the like.

Figure 3A:
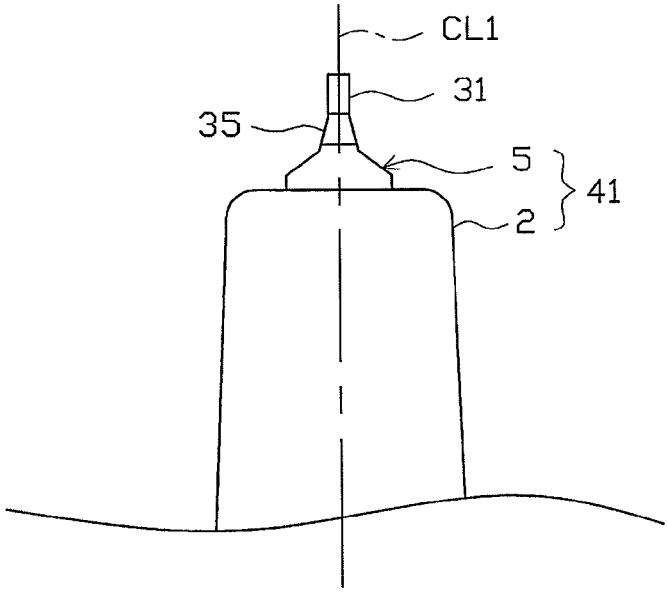
FIG. 3A is a partial enlarged front view showing the structure of a center electrode assembly.

The ceramic insulator 2 and the center electrode 5, which have been fabricated as described above, the resistor 7, and the terminal electrode 6 are fixed together and sealed by means of the glass seal layers 8 and 9. Thus, as shown in FIG. 3A, a center electrode assembly 41 including the ceramic insulator 2 and the center electrode 5 provided therein is formed. In general, the glass seal layers 8 and 9 are formed as follows. A powder mixture, prepared by mixing borosilicate glass powder and metal powder, is charged into the axial hole 4 of the ceramic insulator 2 so that the resistor 7 is sandwiched by the powder mixture, and the terminal electrode 6 is then inserted and pressed from the rear side. In this state, the powder mixture is baked within a firing furnace. Notably, at that time, a glaze layer may be simultaneously formed on the surface of the rear-end-side trunk portion 10 of the ceramic insulator 2 by firing. Alternatively, the glaze layer may be formed in advance.

The metallic shell 3 is previously fabricated. That is, a cold forging operation is performed on a cylindrical columnar metal material (e.g., iron material or stainless steel material such as S17C or S25C) so as to form a through hole therein and impart a rough shape to the metal material. Subsequently, a cutting operation is performed on the metal material so as to impart a predetermined outer shape to the metal material, and the thread portion 15 is formed at a predetermined portion through rolling. Thus, a metallic shell intermediate is obtained. Further, zinc plating or nickel plating is performed for the metallic shell intermediate. Notably, in order to increase corrosion resistance, the surface of the metallic shell intermediate may be treated with chromate.

Subsequently, cutting or the like is performed on the front end portion of the metallic shell intermediate, whereby the metallic shell 3 having an inclined front end face 26 is obtained. Notably, as a result of cutting or the like, the plating layer is removed from the front end face 26 of the metallic shell 3.

Figure 3B:
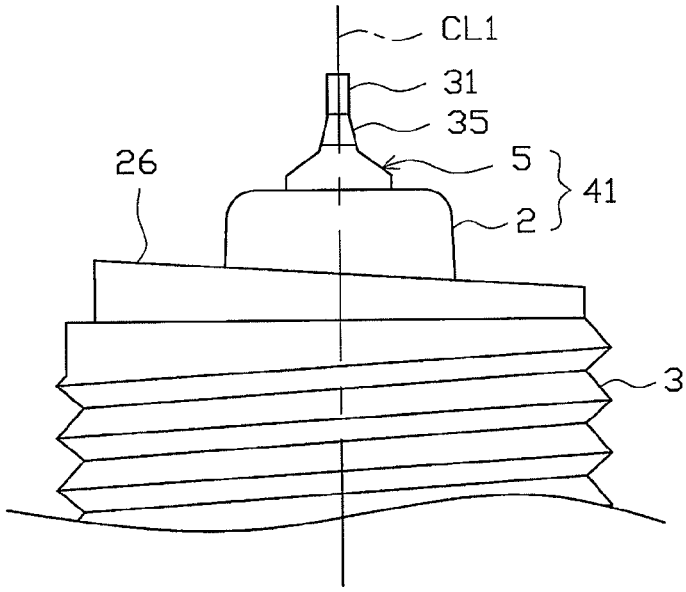
FIG. 3B is a partial enlarged front view showing a metallic shell, etc., assembled to the center electrode assembly.

After that, as shown in FIG. 3B, the metallic shell 3 is fixed to the center electrode assembly 41. More specifically, the center electrode assembly 41 is inserted into the metallic shell 3, and a rear-end-side opening portion of the metallic shell 3, which portion has a relatively small wall thickness, is crimped radially inward; i.e., the above-described crimped portion 20 is formed. As a result, the metallic shell 3 is fixed to the center electrode assembly 41.

Meanwhile, a straight ground electrode 27 is formed by means of cutting a wire material formed of an Ni alloy. Further, the noble metal chip 32, which is previously fabricated, is joined to the distal end face of the ground electrode 27 by means of laser welding or electron beam welding, and the ground electrode 27 is then bent. Notably, the ground electrode 27 is bent in consideration of the diameter of the noble metal chip 31, the inner diameter of the metallic shell 3, and the size of the spark discharge gap 33 to be formed, such that the length D between the bent portion and the distal end of the noble metal chip 32 attains a predetermined value.

After that, the ground electrode 27 is resistance-welded to the front end face 26 of the metallic shell 3 fixed to the center electrode assembly 41. At that time, the ground electrode 27 is joined to the front end face 26 of the metallic shell 3 at a circumferential position at which the distal end portion (the noble metal chip 32) of the ground electrode 27 has a desired position relative to the front end portion of the center electrode assembly 41 (in the present embodiment, the noble metal chip 31).

Figure 4A:
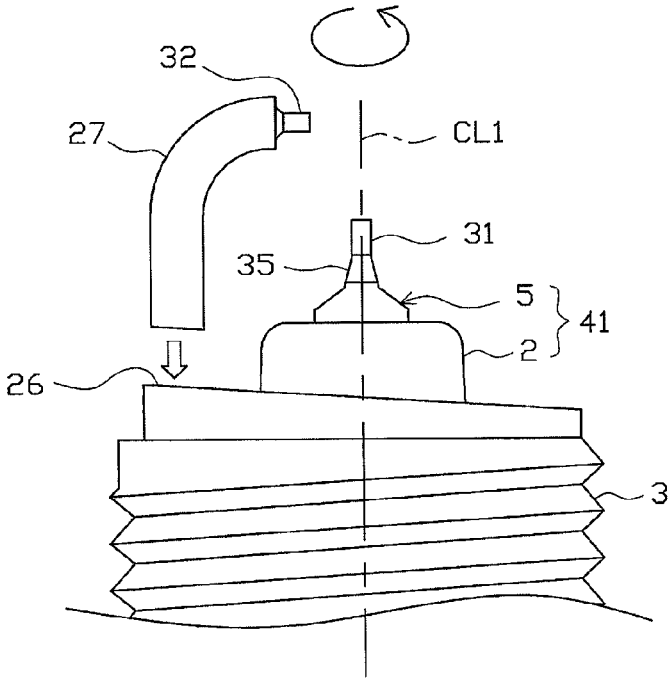
FIG. 4A is a partial enlarged front view which shows joining of a ground electrode to the metallic shell.

More specifically, the length of the ground electrode 27 as measured along the axis CL1 and the position of the center electrode assembly 41 relative to the metallic shell 3 are checked. A region of the front end face 26 of the metallic shell 3 is selected as a joint surface in such a manner that, when the base end of the ground electrode 27 is joined to the joint surface, the distal end face of the noble metal chip 32 faces the side surface of the noble metal chip 31 without facing the fused portion 35 or a distal-end edge portion of the noble metal chip 31. Subsequently, as shown in FIG. 4A, the metallic shell 3 is rotated about the axis CL1 such that the base end portion of the ground electrode 27 is aligned with the selected joint surface, and the ground electrode 27 is joined to the front end face 26 of the metallic shell 3. Notably, after joining the ground electrode 27, the size of the spark discharge gap 33 may be finely adjusted.

Figure 4B:
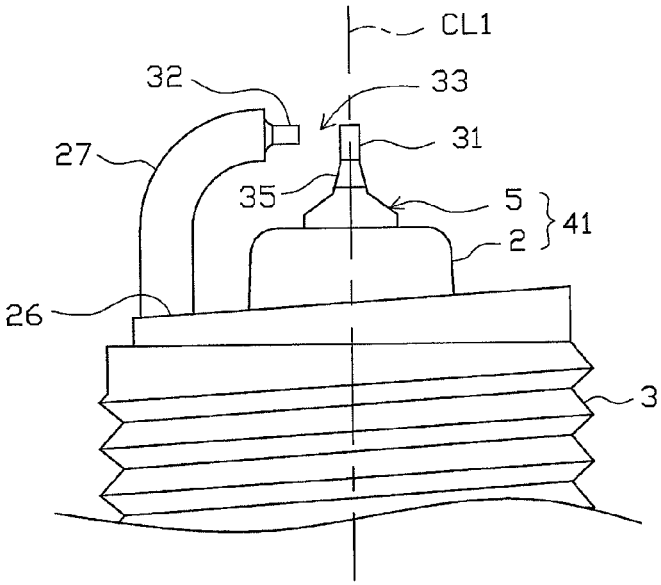
FIG. 4B is a partial enlarged front view showing the metallic shell, etc., in a state in which the ground electrode is joined to the metallic shell.

After that, a so-called "sag" produced at the time of joining of the ground electrode 27 is removed. Thus, as shown in FIG. 4B, the above-described spark plug 1 is completed.

As described in detail, according to the present embodiment, the front end face 26 of the metallic shell 3 is formed such that the distance from a reference plane SP varies along a circumferential direction. Therefore, by changing the portion of the front end face 26 of the metallic shell 3 to which the ground electrode 27 is joined, the relative position of the ground electrode 27 to the center electrode assembly 41 along the axis CL1 can be adjusted. Thus, it is possible to position the distal end face of the noble metal chip 32 to face the side surface of the noble metal chip 31 without any deviation in the direction of the axis CL1. As a result, it is possible to more reliably prevent the distal end portion of the noble metal chip 32 from being disposed to face the fused portion 35 or the distal-end edge portion of the center electrode 5. Thus, ablation resistance can be increased, and falling off of the noble metal chip 31 can be prevented.

Furthermore, the ground electrode 27 is formed such that the length D of a portion extending from the bent portion to the distal end is equal to or less than 4 mm, and the length D of the portion extending from the bent portion to the distal end is smaller than the length H of a portion extending from the bent portion to the base end. That is, the ground electrode 27 used in the present embodiment is difficult to bend in a desired shape if it is bent after being joined to the metallic shell 3. In the present embodiment, since the ground electrode 27 is previously bent before being joined to the metallic shell 3, the ground electrode 27 can be bent into a desired shape. Furthermore, since the position of the distal end portion (the noble metal chip 32) of the ground electrode 27 relative to the center electrode assembly 41 along the axis CL1 can be readily adjusted, a problem can be solved that would otherwise arise when the method of joining a bent ground electrode 27 to the metallic shell 3 is employed.

Moreover, the angle which the front end face 26 of the metallic shell 3 forms relative to the reference plane SP is set to a relatively small angle of 2° or less. Accordingly, the relative position of the distal end portion of the ground electrode 27 relative to the center electrode assembly 41 along the axis CL1 can be adjusted accurately. Meanwhile, since the angle which the front end face 26 of the metallic shell 3 forms relative to the reference plane SP is set to be equal to or greater than 1°, the adjustable range of the position of the distal end portion of the ground electrode 27 relative to the center electrode assembly 41 can be prevented from becoming excessively narrow.

Furthermore, since the front end face 26 of the metallic shell 3 is inclined, the position of the ground electrode 27 relative to the center electrode assembly 41 along the axis CL1 can be adjusted continuously rather than stepwise.

Figure 5A:
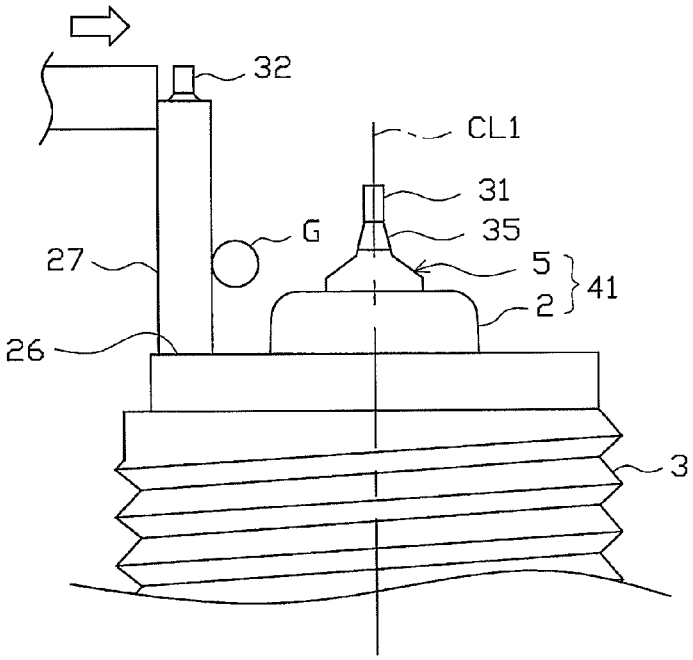
FIGS. 5A and 5B are schematic front views used to explain a method of bending the ground electrode after the ground electrode is joined to the metallic shell.
Figure 5B:
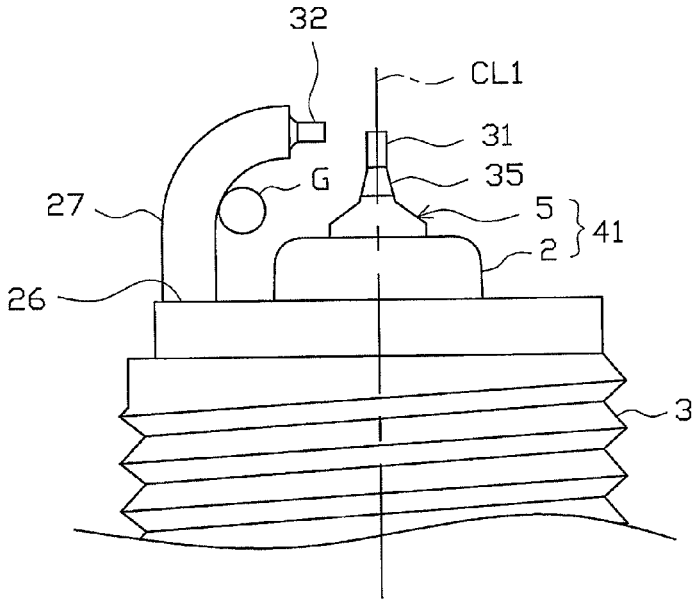

Next, a test was performed so as to determine a preferred shape of the ground electrode for performing a process of previously bending the ground electrode and joining the bent ground electrode to the metallic shell (in other words, determining which shape raises difficulty in performing a process of bending the ground electrode after being joined to the metallic shell). In the test, seven spark plugs were manufactured such that, after a straight ground electrode was joined to a metallic shell, the ground electrode was bent such that the length D of a portion extending from the bent portion to the distal end of the ground electrode varied among the seven spark plugs. The method of bending the ground electrode will be described in detail. First, as shown in FIG. 5A, a bar-like jig G was disposed between the ground electrode 27 and the center electrode assembly 41 such that the jig G came into contact with a portion of the ground electrode 27 to be bent. The jig G has a predetermined shape corresponding to a target inside shape of the portion of the ground electrode 27 to be bent. Subsequently, a distal end portion of the ground electrode 27 was pressed from the back surface side thereof, whereby the ground electrode 27 was bent as shown in FIG. 5B (FIG. 5B shows the ground electrode 27 bent in a desired shape). Notably, when the ground electrode 27 was pressed, a force was applied to the jig G in a direction opposite the pressing direction so as to prevent the base end portion of the ground electrode 27 from leaning toward the center electrode 5.

Each spark plug whose ground electrode was able to be bent into a desired shape and in which a spark discharge gap of a desired size was able to be formed was evaluated "Good." Each spark plug whose ground electrode was able to be bent into a desired shape but which had a variation (about 0.1 mm) in the size of the spark discharge gap was evaluated "Fair." Each spark plug whose ground electrode was not able to be bent into a desired shape (for example, the base end portion of the ground electrode deformed outwardly and the ground electrode was formed into a generally C-like shape) was evaluated "Poor." Table 1 shows the set lengths D and evaluation results for bending of the ground electrode. Notably, each of the ground electrodes was bent such that the length H of the portion extending from the bent portion to the base end became 4.0 mm.

TABLE 1

| D(mm) | 2.1 | 2.7 | 3.4 | 4.0 | 4.2 | 4.6 | 5.2 |
|---|---|---|---|---|---|---|---|
| Evaluation on bending of ground electrode | Poor | Poor | Fair | Fair | Good | Good | Good |

Table 1 shows that, in the case where the length D is greater than 4.0 mm, the ground electrode can be bent into a desired shape, and a spark discharge gap of a desired size can be formed. Table 1 also shows that, in the case where the length D is equal to or less than 4.0 mm, some trouble arises when the ground electrode is bent. In other words, in the case where a ground electrode whose length D is equal to or less than 4.0 mm is used, the ground electrode is desirably bent in advance, and the bent ground electrode is joined to the metallic shell as in the above-described embodiment, Subsequently, seven spark plugs were manufactured in such a manner that, after a straight ground electrode was joined to a metallic shell, the ground electrode was bent by the above-described method such that the length D (as measured from the bent portion to the distal end of the ground electrode) and the length H (as measured from the bent portion to the base end of the ground electrode) varied among the seven spark plugs. A spark plug whose ground electrode was able to be bent into a desired shape and in which a spark discharge gap of a desired size was able to be formed was evaluated "Good." Each spark plug which had a variation (about 0.1 mm) in the size of the spark discharge gap or whose ground electrode was not able to be bent into a desired shape was evaluated "Poor." Table 2 shows the set lengths D and H and the evaluation results for bending of the ground electrode.

TABLE 2

| D(mm) | 2.1 | 2.7 | 3.2 | 3.8 | 4.0 | 4.5 | 4.5 |
|---|---|---|---|---|---|---|---|
| H(mm) | 5.0 | 5.0 | 5.0 | 5.0 | 5.0 | 5.0 | 3.5 |
| Evaluation on bending of ground electrode | Poor | Poor | Poor | Poor | Poor | Poor | Good |

Table 2 shows that, in the case where the length D is equal to or less than 4.0 mm, some trouble arises when the ground electrode is bent, as found in the test results shown in Table 1. Table 2 also shows that, even in the case where the length D is greater than 4.0 mm, if the length H is greater than the length D, some trouble arises when the ground electrode is bent. Accordingly, in the case where a ground electrode in which the length D is smaller than the length H is used, the ground electrode is preferably bent in advance before joining the ground electrode to the metallic shell.

Second Embodiment

Next, a second embodiment will be described. In the following description, the differences between the second and first embodiments will mainly be described.

Figure 6A:
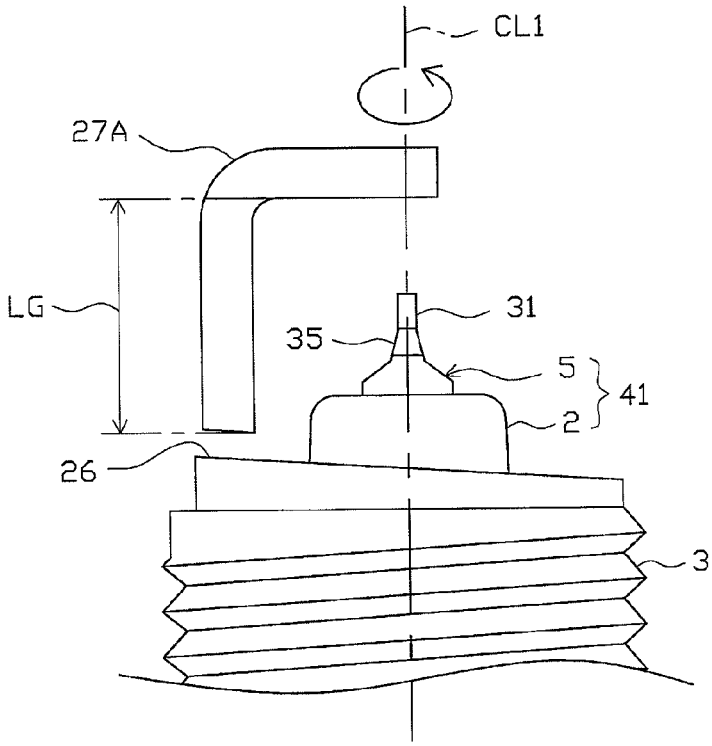
FIGS. 6A and 6B are partial enlarged front views used to explain, among other things, joining of the ground electrode in another embodiment.
Figure 6B:
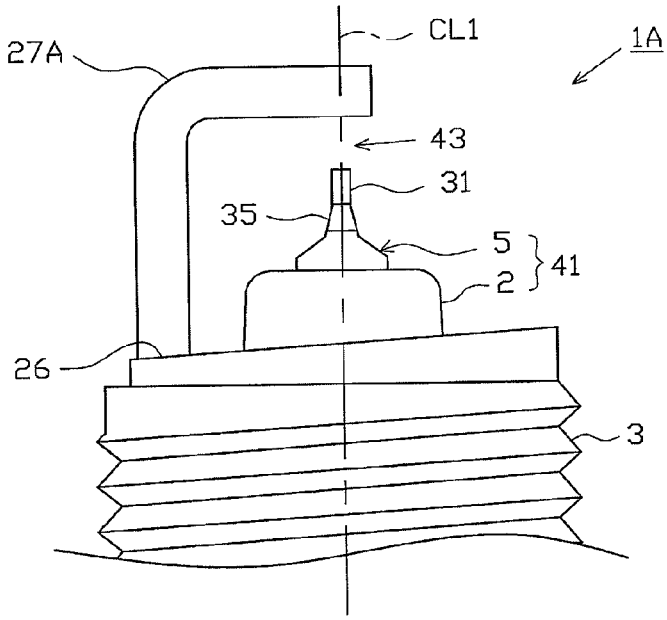

As shown in FIG. 6B, a spark plug 1A according to the second embodiment differs from that of the first embodiment, in particular, in the shape of a ground electrode 27A and the location where a spark discharge gap 43 is formed. Specifically, the above-mentioned noble metal chip 32 is not provided on the ground electrode 27A, and the spark discharge gap 43 is formed between the distal end face of the noble metal chip 31 and a side surface of a distal end portion of the ground electrode 27A on the side toward the center electrode 5. In the spark discharge gap 43, spark discharge occurs in a direction approximately parallel to the axis CL1.

The ground electrode 27A is joined to the front end face 26 of the metallic shell 3 at a position at which the distance between the side surface of the distal end portion of the ground electrode 27A and the distal end face of the noble metal chip 31 becomes approximately equal to the size of the spark discharge gap 43 to be formed, as measured along the axis CL1. That is, as shown in FIG. 6A, a length LG (as measured along the axis CL1) between the side surface (located on the side toward the center electrode 5) of the distal end portion of the ground electrode 27A and the base end of the ground electrode 27A is checked. Subsequently, a region of the front end face 26 of the metallic shell 3 is selected as a joint surface such that the distance between the selected joint surface and a point which is separated from the distal end face of the noble metal chip 31 along the axis CL1 by the size of the spark discharge gap 43 to be formed becomes approximately equal to the length LG set in consideration of a welding allowance. Subsequently, the metallic shell 3 is rotated about the axis CL1 such that the base end portion of the ground electrode 27A is aligned with the selected joint surface, and the ground electrode 27A is joined to the metallic shell 3.

As described in detail, according to the second embodiment, the height of the distal end portion of the ground electrode 27A relative to the center electrode 5 (the noble metal chip 31) can be readily adjusted. Therefore, the size of the spark discharge gap 43 can be readily adjusted.

The present invention is not limited to the details of the above-described embodiments, and may be practiced as follows. Needless to say, other applications and modifications not illustrated below are also possible. It is intended that such changes be included within the spirit and scope of the claims appended hereto.

Figure 7A:
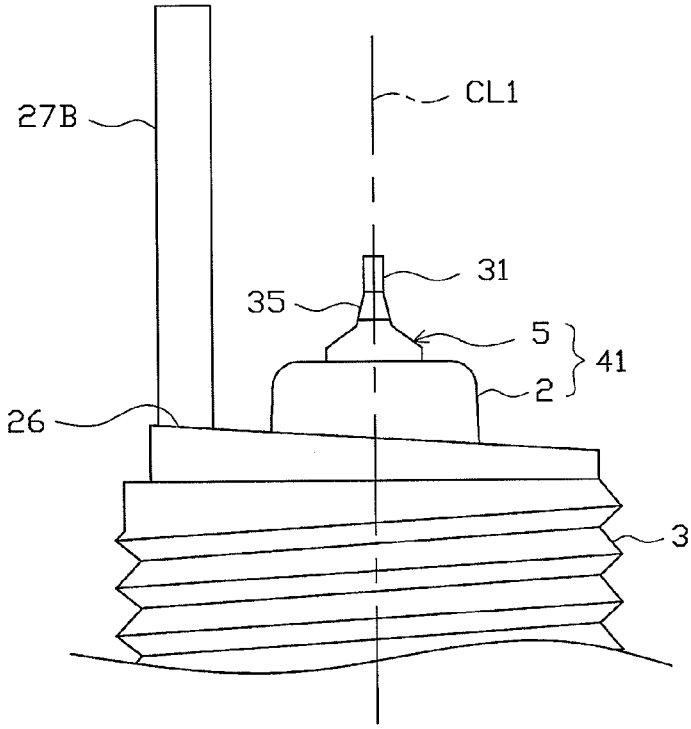
FIGS. 7A and 7B are partial enlarged front views used to explain joining and bending of the ground electrode in another embodiment.
Figure 7B:
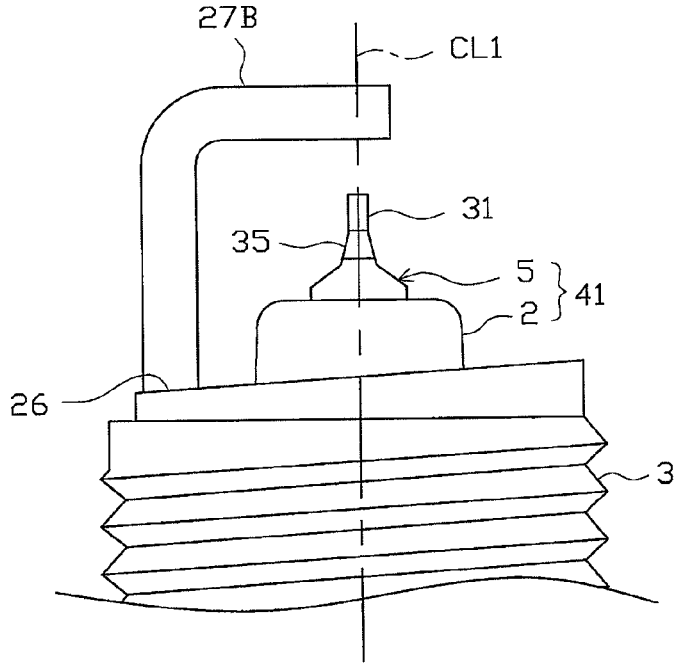

(a) In the above-described embodiments, the ground electrode 27 (27A) is bent in advance, and the bent ground electrode 27 (27A) is joined to the front end face 27 of the metallic shell 3. However, the embodiments may be modified such that, as shown in FIGS. 7A and 7B, a straight ground electrode 27B is joined to the metallic shell 3, and is then bent. This modification does not require conventionally required work; i.e., the work of cutting a distal end portion of the ground electrode 27 in consideration of the position of the center electrode assembly 41 relative to the metallic shell 3. Therefore, productivity can be improved.

Figure 8A:
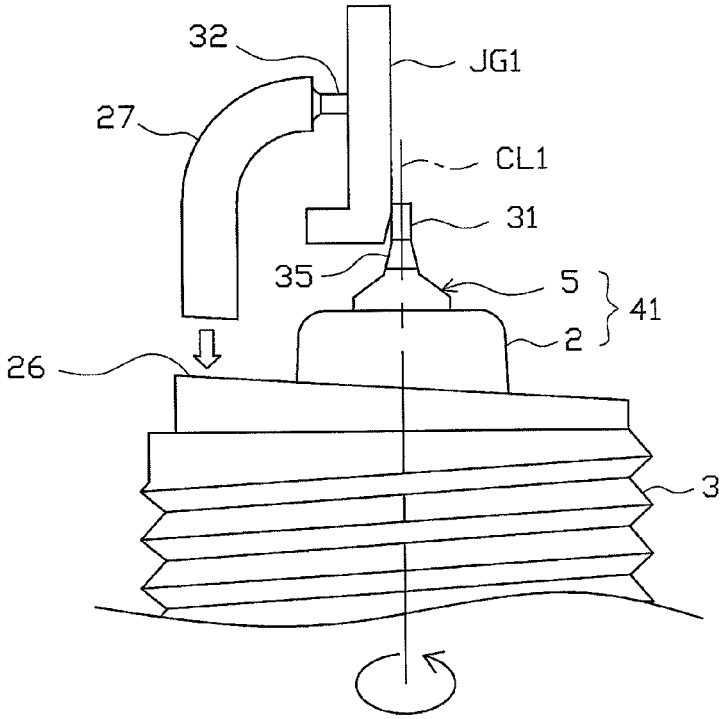
FIGS. 8A and 8B are enlarged front views used to explain a jig used in another embodiment.
Figure 8B:
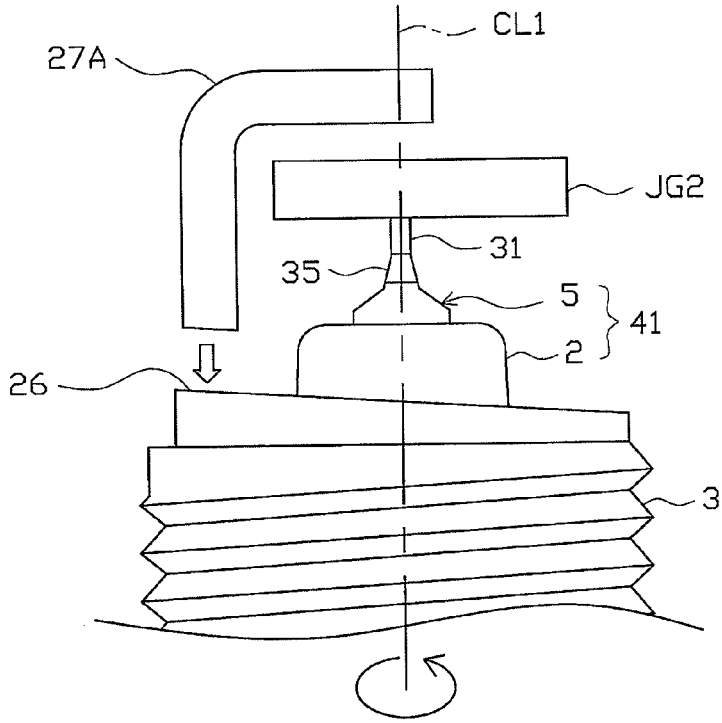

(b) Although not described specifically in the described embodiments, a jig may be used so as to facilitate adjustment of the position of the ground electrode 27 relative to the center electrode assembly 41. Specifically, the position of the ground electrode 27 relative to the center electrode assembly 41 is adjusted in a state in which a jig corresponding to a desired (ideal) position of the ground electrode 27 relative to the center electrode assembly 41 is disposed between the front end portion of the center electrode assembly 41 and the ground electrode 27. Accordingly, in the first embodiment, as shown in FIG. 8A, the position of the ground electrode 27 relative to the center electrode assembly 41 may be adjusted by use of a generally L-shaped jig JG1 which can adjust the positional relation between the center electrode assembly 41 and the ground electrode 27 along the axis CL1, as well as the size of the spark discharge gap 33. Furthermore, in the second embodiment, as shown in FIG. 8B, the position of the ground electrode 27A relative to the center electrode assembly 41 may be adjusted by use of a jig JG2 which assumes the form of a flat plate and which can adjust the size of the spark discharge gap 43.

Figure 9A:
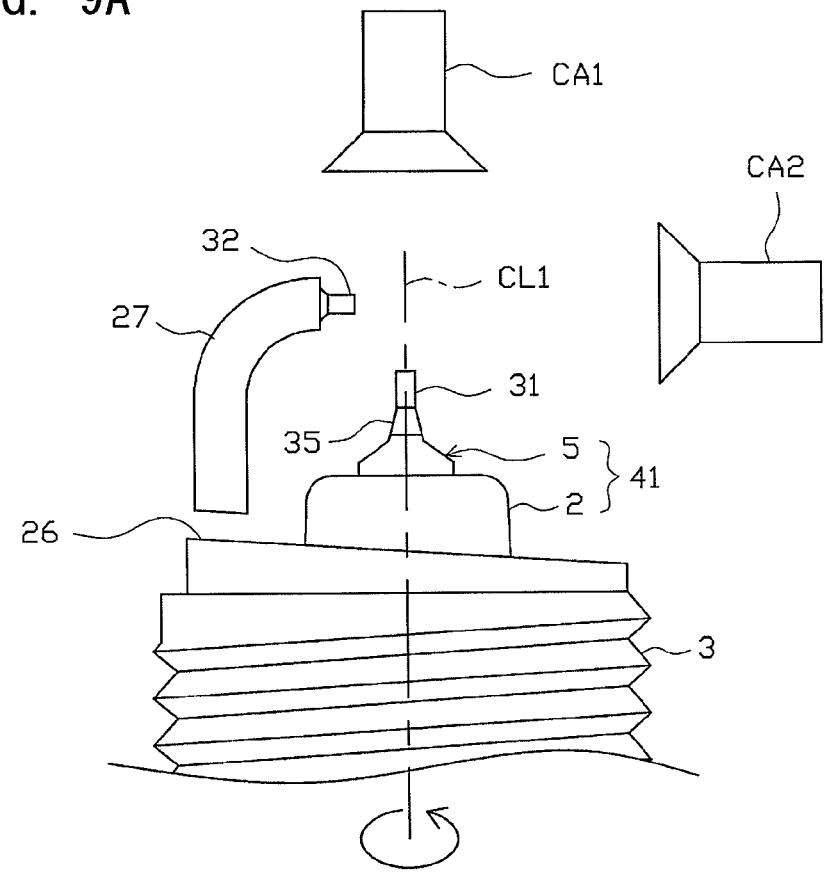
FIGS. 9A and 9B are enlarged front views showing imaging means used in another embodiment.
Figure 9B:
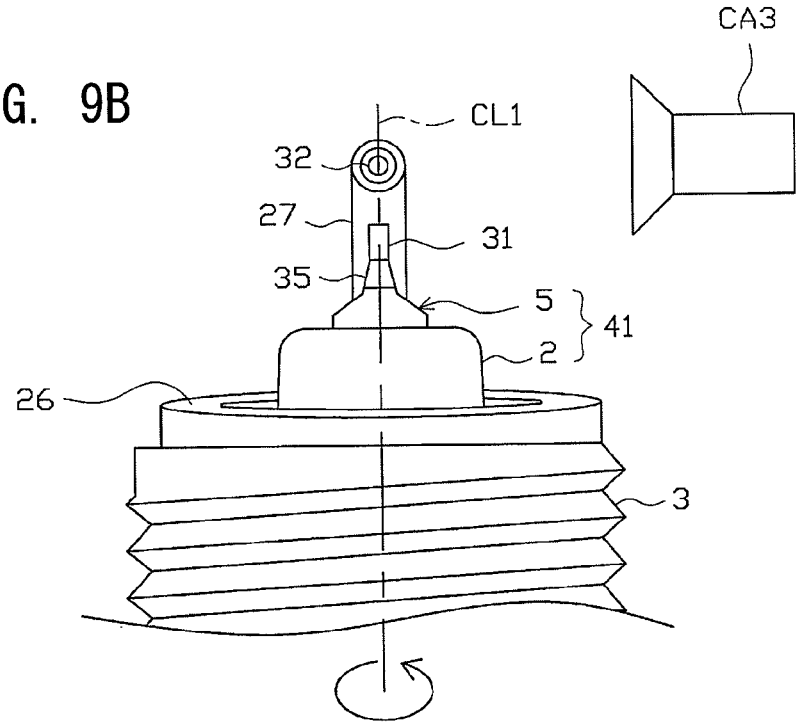

(c) Although not described specifically in the above-described embodiments, as shown in FIGS. 9A and 9B, imaging means (e.g., CCD cameras) CA1, CA2 and CA3 for capturing images of a front end portion of the center electrode assembly 41 and a distal end portion of the ground electrode 27, and a display monitor (not shown) may be used. In this case, images displayed on the display monitor on the basis of the image data from the imaging means CA1, CA2, CA3 enable a worker to accurately adjust the position of the ground electrode 27 such that the ground electrode 27 has a desired positional relation with the center electrode assembly 41, while checking the positional relation between the front end portion of the center electrode assembly 41 and the distal end portion of the ground electrode 27.

Figure 10:
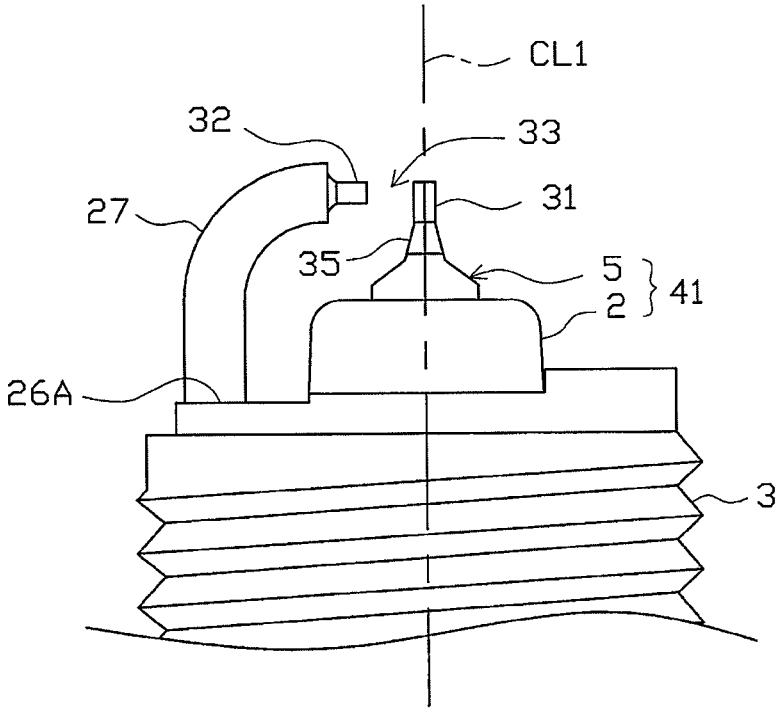
FIG. 10 is a partial enlarged front view showing the configuration of the front end face of the metallic shell in another embodiment.

(d) In the above-described embodiments, the front end face 26 of the metallic shell 3 is inclined such that the distance from the reference plane SP along the axis CL1 varies in the circumferential direction. However, the configuration of the front end face 26 of the metallic shell 3 is not limited thereto. For example, as shown in FIG. 10, a plurality of steps each having a predetermined height (e.g., about 0.1 mm) may be provided on the front end face 26A of the metallic shell 3. Furthermore, only a portion of the front end face 26 of the metallic shell 3 may be inclined. Notably, in the above-described embodiments, the angle formed between the front end face 26 of the metallic shell 3 and the reference plane SP is 1° to 2°. However, the angle formed between the front end face 26 of the metallic shell 3 and the reference plane SP is not limited thereto.

(e) In the above-described embodiments, the noble metal chip 31 is provided on the front end portion of the center electrode 5. However, the noble metal chip 31 may be omitted. Notably, in the case where the noble metal chip 31 is omitted, the spark discharge gap 33 (43) is formed between the front end portion of the center electrode 5 and the noble metal chip 32 (the distal end portion of the ground electrode 27).

(f) In the above-described embodiments, the nominal diameter of the thread portion 15 is M12 or less. However, the nominal diameter of the thread portion 15 is not limited to that size.

(g) In the above-described embodiments, the tool engagement portion 19 has a hexagonal cross section. However, the shape of the tool engagement portion 19 is not limited thereto. For example, the tool engagement portion may have a Bi-Hex (deformed dodecagon) shape [ISO22977: 2005(E)] or the like.

This application is based on Japanese Patent Application No. 2009-147150 filed Jun. 22, 2009, incorporated herein by reference in its entirety.

What is claimed is:

1. A method of manufacturing a spark plug, the spark plug including a tubular metallic shell extending in an axial direction; a tubular insulator provided inside the metallic shell; a rod-like center electrode provided inside the insulator and positioned coaxial with the metallic shell; and a ground electrode whose base end portion is joined to a front end face of the metallic shell and which forms a gap between a distal end portion thereof and the center electrode, the manufacturing method comprising:

assembling together the metallic shell and a center electrode assembly including the insulator and the center electrode provided therein; and joining the ground electrode to the front end face of the metallic shell after the assembling step, wherein the distance between a plane perpendicular to the axis and the front end face of the metallic shell as measured along the axis continuously varies around the entire front end face in a circumferential direction of the metallic shell; and the joining step comprises adjusting the position of a distal end portion of the ground electrode relative to the front end portion of the center electrode assembly along the axis by changing a region of the front end face of the metallic shell to which the ground electrode is joined.

2. The method of manufacturing a spark plug according to claim 1, which comprises bending the ground electrode to form a bent portion before the joining step.

3. The method of manufacturing a spark plug according to claim 2, wherein the joining step comprises adjusting the size of the gap.

4. The method of manufacturing a spark plug according to claim 2, wherein the ground electrode has a length of 4 mm or less as measured from the bent portion to the distal end thereof.

5. The method of manufacturing a spark plug according to claim 2, wherein a length of the ground electrode as measured from the bent portion to the distal end thereof is smaller than a length of the ground electrode as measured from the bent portion to the base end thereof.

6. The method of manufacturing a spark plug according to claim 1, which comprises disposing a jig for adjusting the relative position between the center electrode assembly and the ground electrode when the relative position is adjusted in the joining step.

7. The method of manufacturing a spark plug according to claim 1, wherein said joining step comprises capturing at least images of a front end portion of the center electrode assembly and a distal end portion of the ground electrode to obtain data regarding the captured images, and adjusting the position of the ground electrode relative to the center electrode assembly on the basis of the data.

8. The method of manufacturing a spark plug according to claim 1, wherein said joining step comprises joining the ground electrode to the front end face of the metallic shell by means of resistance welding in a state in which an angle formed between the plane perpendicular to the axis and a portion of the front end face of the metallic shell to which portion the ground electrode is to be joined differs from an angle formed between the plane and a surface of the ground electrode, which surface of the ground electrode is to be joined to the metallic shell.

9. The method of manufacturing a spark plug according to claim 1, which comprises joining a noble metal chip to the distal end portion of the ground electrode before the joining step.

10. A spark plug comprising:

a tubular metallic shell extending in an axial direction;

a tubular insulator provided inside the metallic shell;

a rod-like center electrode provided inside the insulator and positioned coaxial with the tubular metallic shell;

and a ground electrode whose base end portion is joined to a front end face of the metallic shell and which forms a gap between a distal end portion thereof and the center electrode, wherein the distance between a plane perpendicular to the axis and the front end face of the metallic shell as measured along the axis continuously varies around the entire front end face in a circumferential direction of the metallic shell.

11. The spark plug according to claim 10, wherein an angle between the plane perpendicular to the axis and the front end face of the metallic shell is from 1° to 2° inclusive.

* * * * *